US006931807B2

(12) United States Patent
Braun

(10) Patent No.: US 6,931,807 B2
(45) Date of Patent: Aug. 23, 2005

(54) BRIDGING DEVICE FOR JOINT GAPS

(75) Inventor: Christian Braun, Holzkirchen (DE)

(73) Assignee: Maurer Sohne GmbH & Co. KG, Munich (DE)

( * ) Notice: Subject to any disclaimer, the term of this patent is extended or adjusted under 35 U.S.C. 154(b) by 0 days.

(21) Appl. No.: 10/414,922

(22) Filed: Apr. 16, 2003

(65) Prior Publication Data

US 2003/0196400 A1 Oct. 23, 2003

(30) Foreign Application Priority Data

Apr. 17, 2002 (DE) ..... 102 17 042
May 22, 2002 (DE) ..... 102 22 690

(51) Int. Cl.[7] ..... E04B 1/62; E04B 1/68; E01C 11/02

(52) U.S. Cl. ..... 52/393; 52/396.05; 404/47; 404/56; 404/68

(58) Field of Search ..... 52/393, 396.04, 52/396.05, 468, 459, 461; 404/47, 56, 68

(56) References Cited

U.S. PATENT DOCUMENTS 3,880,540 A * 4/1975 Rizza et al. ..... 404/69
4,050,207 A * 9/1977 Bertschmann et al. ... 52/396.05
4,076,440 A * 2/1978 Bertschmann ..... 404/69
4,516,284 A * 5/1985 Huber et al. ..... 14/73.1
5,051,024 A * 9/1991 Warthmann ..... 404/57
5,302,050 A * 4/1994 Buckenauer et al. ..... 404/53
5,887,308 A * 3/1999 Walter ..... 14/73.1
5,964,069 A * 10/1999 Schmidt ..... 52/396.05
6,581,347 B1 * 6/2003 Knak et al. ..... 52/396.04
6,609,265 B1 * 8/2003 Jee ..... 14/73.1
6,675,539 B2 * 1/2004 Shreiner ..... 52/66

* cited by examiner

*Primary Examiner*—Anita M. King
(74) *Attorney, Agent, or Firm*—Welsh & Katz, Ltd.

(57) ABSTRACT

A bridging device for joint gaps (1) between building parts (2, 3) including bridge parts, with an expansion joint construction (4) bridging a joint gap (1). The expansion joint construction (4) permits position changes of the building parts (2, 3) with respect to one another. A safety construction (12, 15) is provided which permits a position change of the building parts (2, 3) with respect to one another without a separation destroying the function of the bridging device. The safety construction (12, 15) comprises at least two mutually firmly connected elements which upon exceeding of a defined threshold load are separated and movable with respect to one another. One element is firmly arranged on one of the building parts (2, 3) and the other element is part of the expansion joint construction (4) or receives the latter. The two connected element are defined by a rail (24)and a slide (25). The slide (24) is displaceable in the rail (25) in order to balance shifting movements including transversal movements between bridge parts.

20 Claims, 13 Drawing Sheets

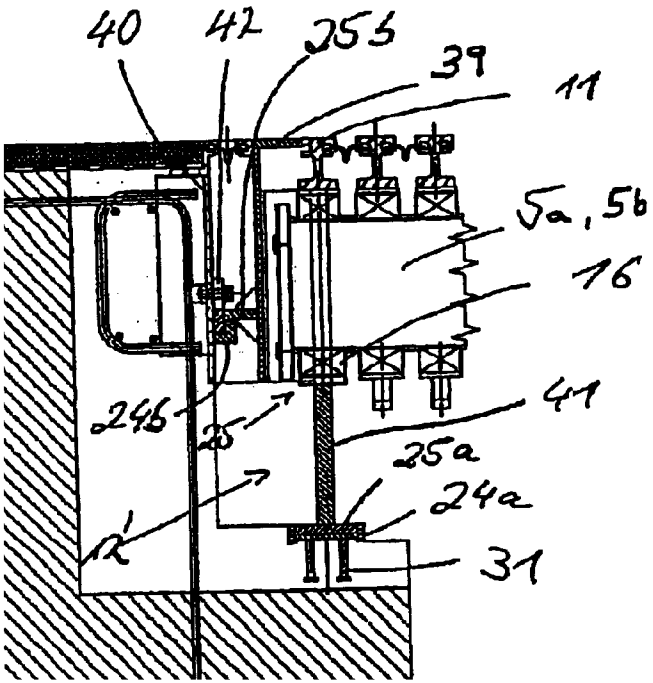
b)
Fig. 14
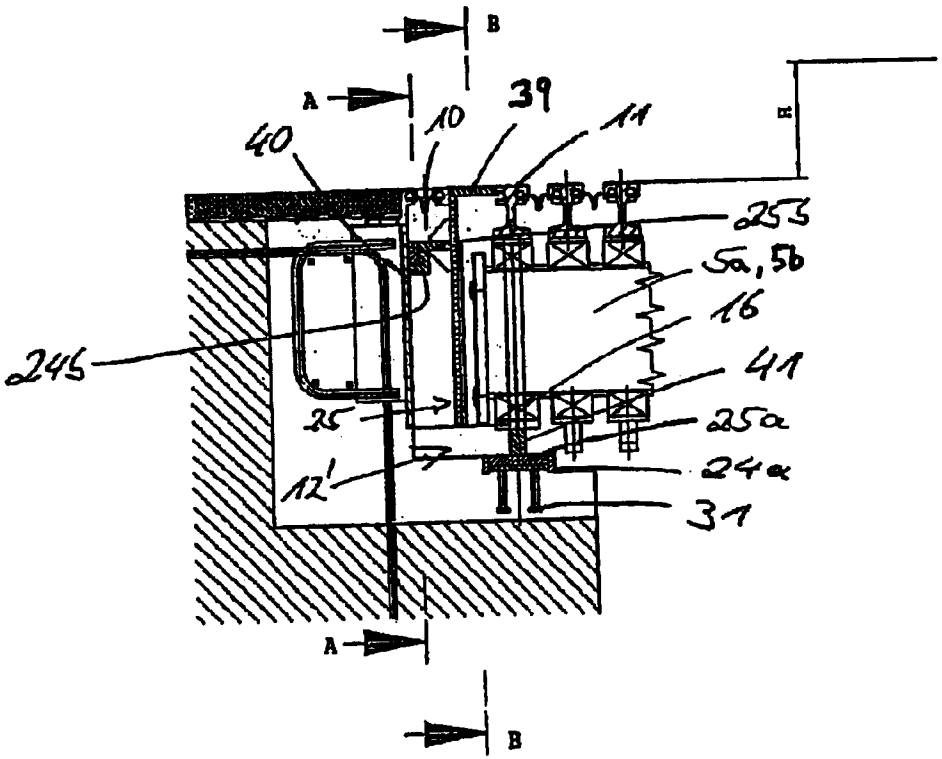
a)

BRIDGING DEVICE FOR JOINT GAPS

BACKGROUND OF THE INVENTION

1. Field of the Invention

The present invention relates to a bridging device for joint gaps between building parts including a safety construction which prevents a separation of the building parts from destroying the brigiding device.

2. Description of the Related Art

In buildings exceeding certain dimensions it is necessary to provide for expansion joints for compensating thermal expansion in order to avoid destruction of the building. This is particularly true for bridge constructions in which thermal expansions can assume enormous dimensions. Therefore, it is known, for bridge constructions in particular, to provide for corresponding bridging devices for joint gaps between building parts, bridge parts in particular. European EP 0 821 104 e.g. discloses such bridging device. Said bridging device disclosed in EP 0 821 104 comprises a safety means which in addition to the compensation of standard dimension alterations permits protection of the expensive expansion joints and edge constructions against destruction in case of extreme loads on the bridging device, in an earthquake e.g.

In spite of the fact that the bridging device disclosed in EP 0 821 104 reliably meets this demand, it nevertheless includes the disadvantage that said bridging device or expansion joint construction, respectively, is no longer suitable for the intended use after the safety means having been actuated, since the expansion joint construction in case of excessive reduction of the width of said joint gap, e.g. by an earthquake, presses the expansion joint construction out of the joint gap. Moreover, said safety means does not permit compensation of other excessive movements exceeding a standard value, of the buildings creating said joint gap, with respect to one another, an enlargement of said joint gap width e.g., exceeding the admissible magnitude or a transversal movement of the building parts with respect to one another, which causes a displacement of the building parts with respect to the joint gap.

SUMMARY OF THE INVENTION

It is, therefore, the main object of the present invention to create a bridging device avoiding these drawbacks of the known bridging devices and to make available a bridging device in particular, which permits securing said expansion joint construction or edge construction at the joint gap against destruction in case of given movement limits of the bordering building parts being exceeded with maintenance of the intended use, wherein various differing movements and limit exceedings are to be secured.

Said object is solved by a bridging device showing the features of claim 1. Preferred embodiments are subject of the depending claims.

The present invention is based on the conception of providing the bridging device with a safety means separable into two elements movable with respect to one another in case of a given threshold load or movement limits being exceeded, which move with respect to one another in a given defined manner under the influence of said excessive load and thus compensate for exceeding of the movement limits of the building parts forming said joint gap. In order to maintain the function of said bridging device or said expansion joint construction, respectively, also in such emergency situations said expansion joint construction, if possible, is to stay in place in said joint gap so that it is required in accordance with the present invention to arrange the elements of said safety means, movable upon having exceeded the threshold load on one of said building parts on one hand and on said expansion joint construction on the other hand, i.e. said safety means is to be provided between expansion joint construction and one of the building parts. In this manner it is possible also in case of exceeding the admissible movement limits of the adjacent building parts to protect said expansion joint construction and/or said edge constructions on said joint gap, even if it has to be accepted in exchange that said safety means possibly may be destroyed by being separated into two parts. However, here the damage is kept in narrow limits in defined way and restoration of said expansion device is possible by simple exchange of said safety means. Moreover, this construction of a safety means in a bridging construction provides the advantage that different kinds of movement can be compensated for.

Thus, in a first aspect of the present invention said safety means is constructed such that it comprises at least one rail and one slide or rail and slide sections, respectively, wherein said slide usually is firmly arranged in said rail but is displaceable after exceeding of a threshold load, in case of an earthquake e.g., for balancing shifting movements, transversal movements in particular, between building parts, bridge parts in particular. Since here again an element, i.e. said rail or said slide, is arranged on a building part, whereas the other element of said safety means accommodates said expansion joint construction or is part thereof, here balancing of transversal movements in particular, between the building parts is possible with a destruction of said bridging device or said expansion joint construction, respectively, occurring.

The realization of said safety means by means of a rail and a slide shiftable therein provides the advantage that also when the threshold load is exceeded no remarkable damage has to occur on said safety means. Thus, it e.g. is of advantage to fix said slide in said rail for generating a given threshold load so that a given frictional force exists between slide and rail, which corresponds to the threshold load, so that below said threshold load no relative movement is possible between rail and slide. Fixation of said slide in said rail can for example be effected in that elastically tensible elements ware arranged between rail and slide, which produce the corresponding frictional force between slide and rail. Preferably, said tensible elements are formed as slide/friction bearings so that after exceeding of a threshold load said elastic elements are not destroyed by the sliding of said slide in said rail.

Alternatively or in addition, of course, also other measurements for generation of a lock to movement for the slide in said rail prior to reaching the threshold load can be taken, i.e. one or several stopping devices can be provided for in said rail, which can be overcome only if a threshold load is exceeded. Preferably, said stop devices can be actuated by said rail itself, in that a predetermined breaking point e.g. is provided for on said stop device.

For being able to release said safety means in case of occurrence of corresponding transverse forces it is advantageous to provide for a release mechanism guaranteeing transmission of said transverse forces to said safety means, i.e. rail and slide. For example, in an expansion joint construction consisting of crossheads bridging the joint gap and central and edge profiles covering said joint gap, which again are arranged on said crossheads, corresponding stop members which with a play to be freely chosen, of the central profiles in direction of the long axis of said gap come into mutual stop and transmit the transversal forces onto said safety means, are provided for on said central and/or edge profiles. Depending on the embodiment of the expansion joint construction one stop member can be sufficient, like e.g. in the swinging crosshead construction which will be described later, in which one stop member on a central profile cooperating with an adjacent edge profile is sufficient.

In a particularly advantageous embodiment of the safety means for compensation of shifting movements and/or transversal movements between bridge components said slide includes a wedge steel sheet which preferably is arranged below the edge profile or the crosshead reception, respectively, so that an oblique arrangement of said edge profile of said expansion joint construction with respect to the horizontally aligned rail is made possible. This preferred embodiment permits use of said transversal safety means also in bridges which are inclined on one side or on both sides across the direction of traffic for permitting drainage of rainwater on the roadway.

Preferably, in such construction said rail as well as said edge constructions are assembled of two components. The second rail in particular serves for keeping a first edge construction movably arranged on said slide and thus in said first rail, with said edge profile from being lifted in vertical direction or in horizontal direction along said long axis of said bridge from being separated from said stationary second edge construction of said bridge component. Therefore, the two rail components preferably are arranged with uniform mutual distance in vertical direction, said upper second rail component being encompassed in hook-like manner by a slide component and being secured by a corresponding lifting lock, in form of holding members e.g., against mutual lifting. Preferably, then between said stationary second edge construction and said first edge construction displaceable with said slide, a sealing profile is provided for which would be torn out of its position in case of actuation of said safety means because of the oblique construction of the displaceable edge construction. An additional damage of said edge construction will, however, not occur in this preferred embodiment of the present invention due to the movably arranged edge construction.

In accordance with a second aspect of the present invention said safety means comprises an in particular ashlar-like basic structure enclosing a given volume, wherein said elements at first firmly mutually connected, which after exceeding of a defined threshold load are mutually movable, are formed by two preferably essentially L-shaped profile forms which after exceeding of said threshold load can shift with respect to one another such that the enclosed volume is consumed or the two opposing sides of the ashlar move towards one another, respectively. Thus, a compensation for an excessive reduction of said joint gap is possible without said expansion joint construction having to be pressed out of said joint gap. Rather will the space assumed by the in particular ashlar-shaped safety means standardly in emergency case made available for accommodation of said expansion joint construction. Thus, again, a simple and low-cost possibility is given to protect said expansion joint construction and/or said edge constructions, respectively, against damage in case of excessive movement of the building parts bordering to said joint gap.

As it is advantageous to make the movement of the elements of said safety means occur in defined manner, in an expansion joint construction comprising crossheads bridging said joint gap it can be provided for in advantageous manner that said crossheads puncture said ashlar-shaped safety means so that said crossheads simultaneously also serve as guides for the movement of the two L-shaped elements of said safety means after exceeding of said threshold load.

Said L-shaped elements of said safety means can be formed of all suitable components, like e.g. full-face steel profiles, grid-like structures, steel sheet metal, edge profile elements, edge profile girders etc. or be composed thereof.

In accordance with a third aspect of the present invention said safety means is built as part of said expansion joint construction, said expansion joint construction including crossheads bridging said joint gap. The two elements of said safety means which at standard load are firmly mutually connected, which, however, at exceeding of the threshold load can separate from one another and move towards one another in defined manner, herein on one hand are formed by an anchoring of said crossheads on a building part and on the other hand by said crosshead body of said crossheads. Said safety means, however, only is realized in the crossheads below a given minimum length which again is in relation with the at maximum admissible joint gap widths. Said short crossheads below a given minimum length namely usually limit the maximum width of said joint gap. If, however, there also still are crossheads with large length, in accordance with the conception of the present invention separation of said short crossheads from their building part anchoring can be taken into account, if still a sufficient number of longer crossheads exits, which grant a certain minimum stability to said bridging device.

Herein, it is particularly advantageous if the crossheads of short length which detach from the anchoring in case of exceeding of threshold load stabilize the side opposite to the anchoring, since beside the small number of supporting crossheads also the minor overlapping of said crossheads with the building part on which they bear can be critical for the stability of the bridging device. This can be achieved in simple manner in that a carrier means is provided for which in case of exceeding of the admissible maximum joint gap entrains said short crossheads with the one building part. Preferably this is done by crosshead plates arranged at the ends of said crosshead, opposing the anchoring, and which with their diameter are designed such that come into stop contact with the edge profile e.g. of the expansion joint construction located opposite to said anchoring.

The construction of a bridging device with a safety means in the above-described manner provides the advantage in particular, that the longer crossheads which are not detached from their anchoring during the emergency situation, in particular together with the covering profiles arranged on said crossheads serve as guide elements for the crossheads detached from their anchoring and thus after a short-time enlargement of the joint gap it also is guaranteed the said expansion joint construction is not destroyed, even if the joint gap closes again. This, apart from that, also is true for the embodiments of the safety means in accordance with the present invention with respect to other emergency situations, transversal movements or excessive closure of said joint gap.

It is particularly advantageous to realize one or several, in particular all embodiments of the safety means in accordance with the present invention in a bridging device to account for all possible loads. Here it turned out to be particularly advantageous to arrange different safety means one separated from the other on different sides of said joint gap.

BRIEF DESCRIPTION OF DRAWINGS

Further advantages, characteristics and features of the present invention will now become evident from the following detailed description of two embodiments. The drawing attached for this purpose shows the following.

BRIEF DESCRIPTION OF THE SEVERAL VIEWS FO THE DRAWINGS

Figure 1:
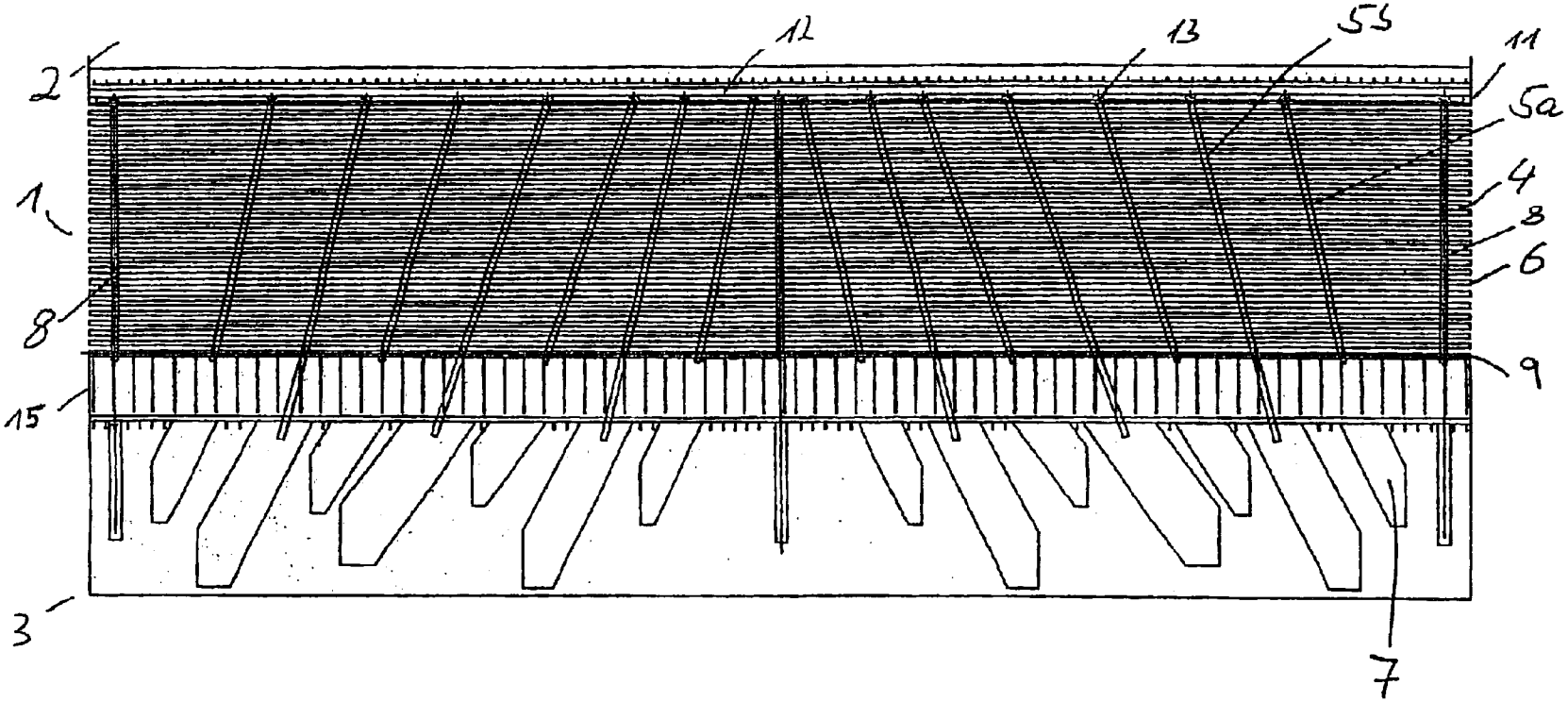

FIG. 1 is a top view onto a bridging device in accordance with the present invention, in which the joint gap has reached its width reachable in maximum in case of standard load.

Figure 2:
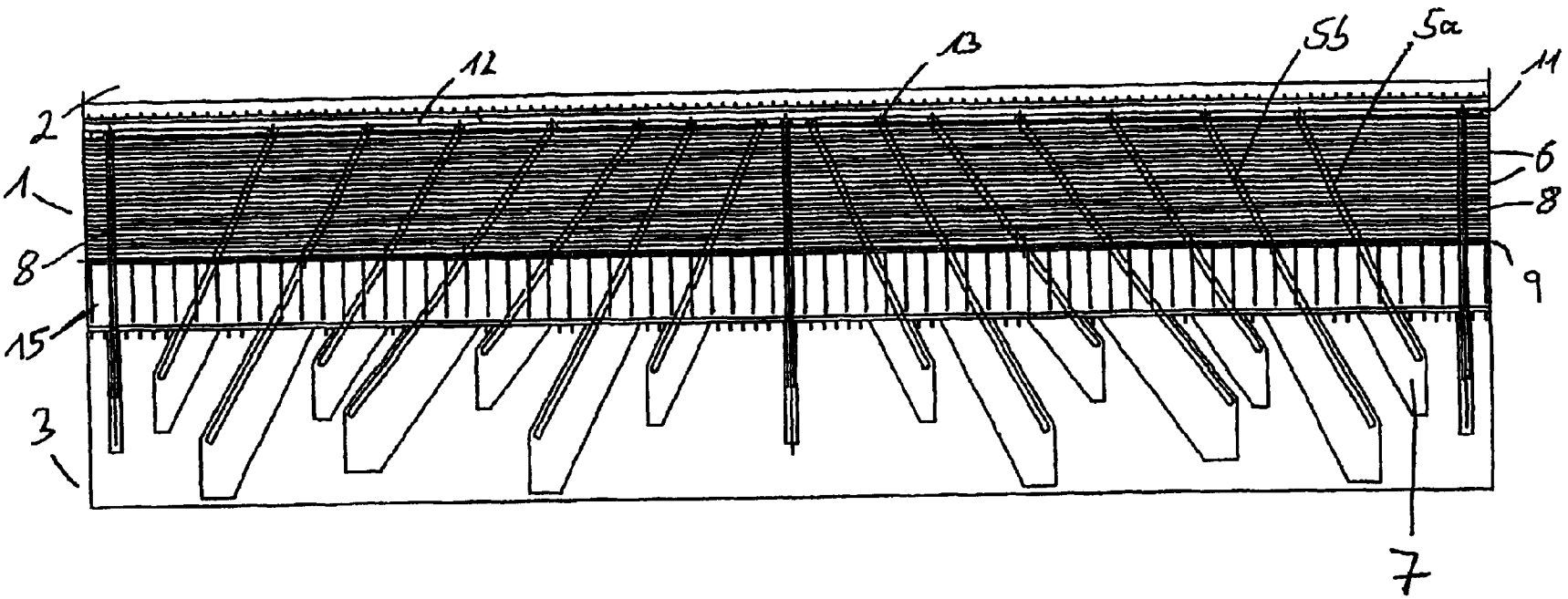

FIG. 2 is a top view onto said bridging device under FIG. 1, in which said joint gap has its minimum width in case of standard load.

Figure 3:
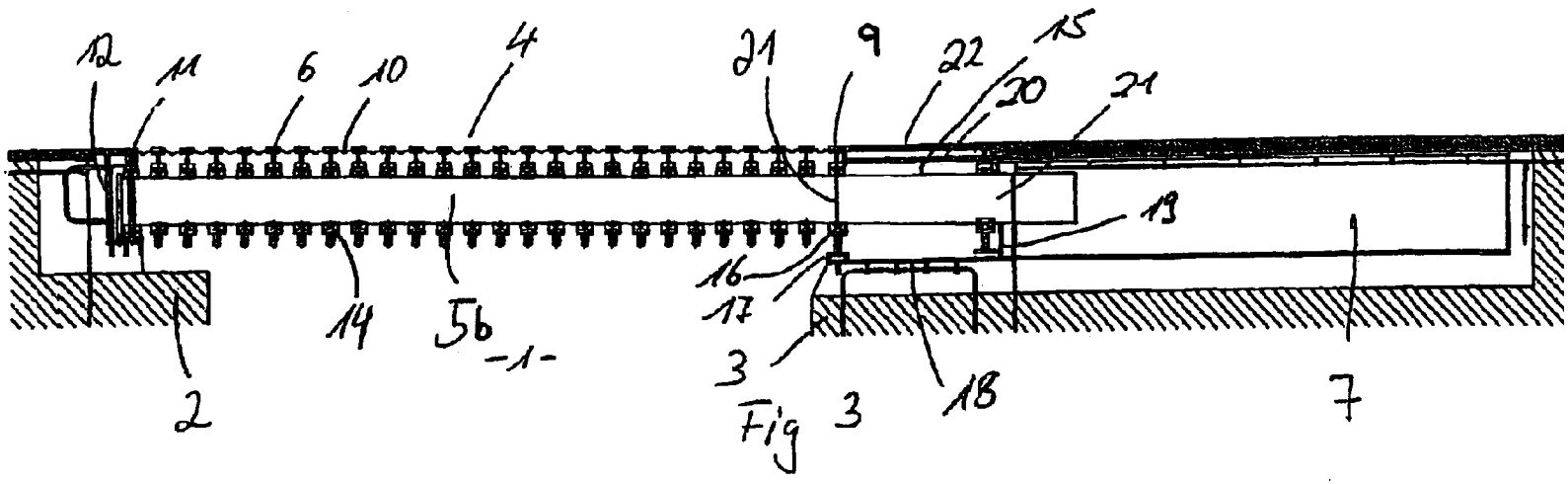

FIG. 3 is a cut view through said bridging device under FIG. 1 with maximum joint gap width with standard load.

Figure 4:
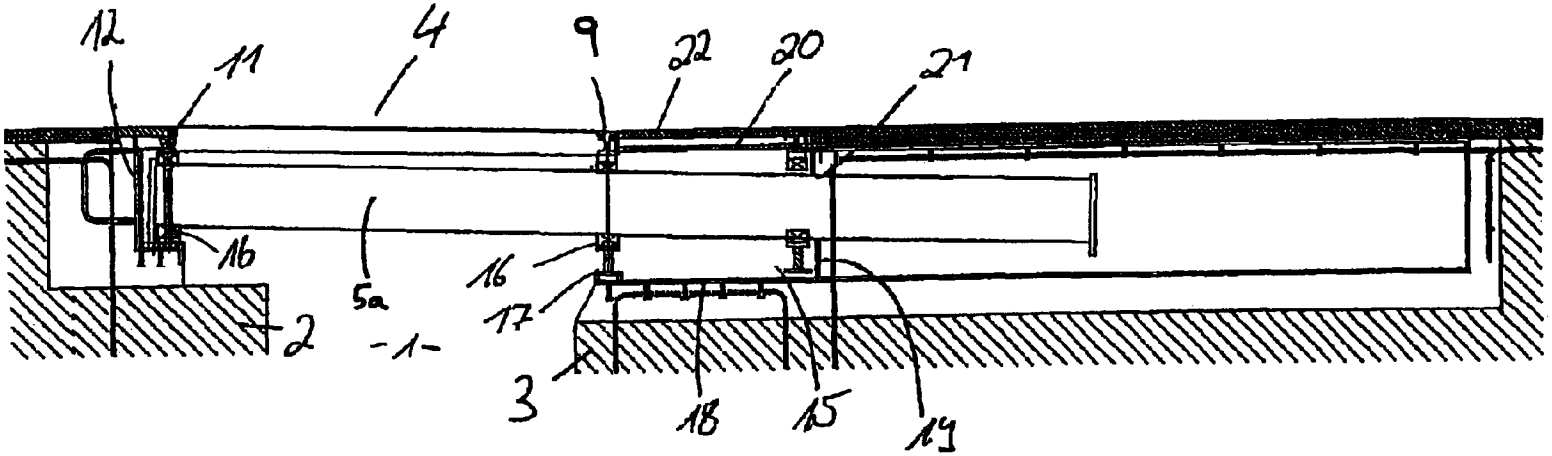

FIG. 4 is a cut view through said bridging device under FIG. 2 with a joint gap width being at a minimum for the standard load.

Figure 5:
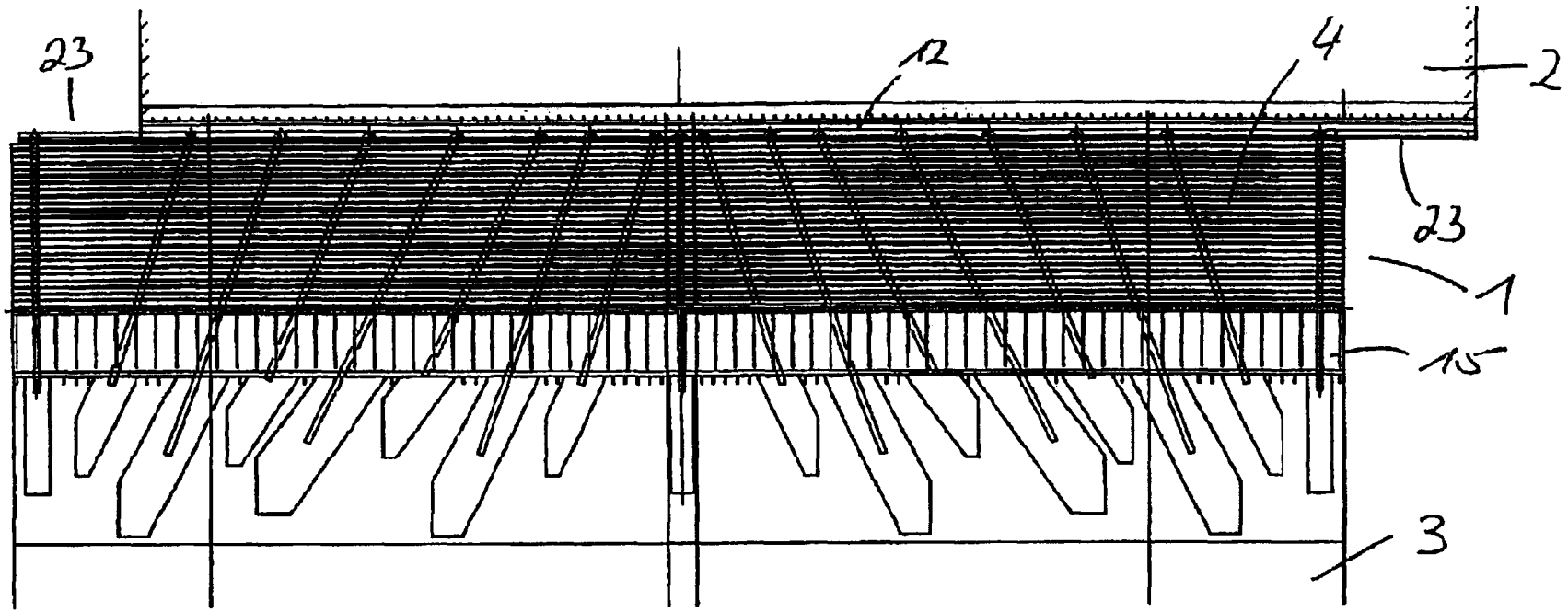

FIG. 5 shows the bridging device under FIG. 1 in case of transversal load.

Figure 6:
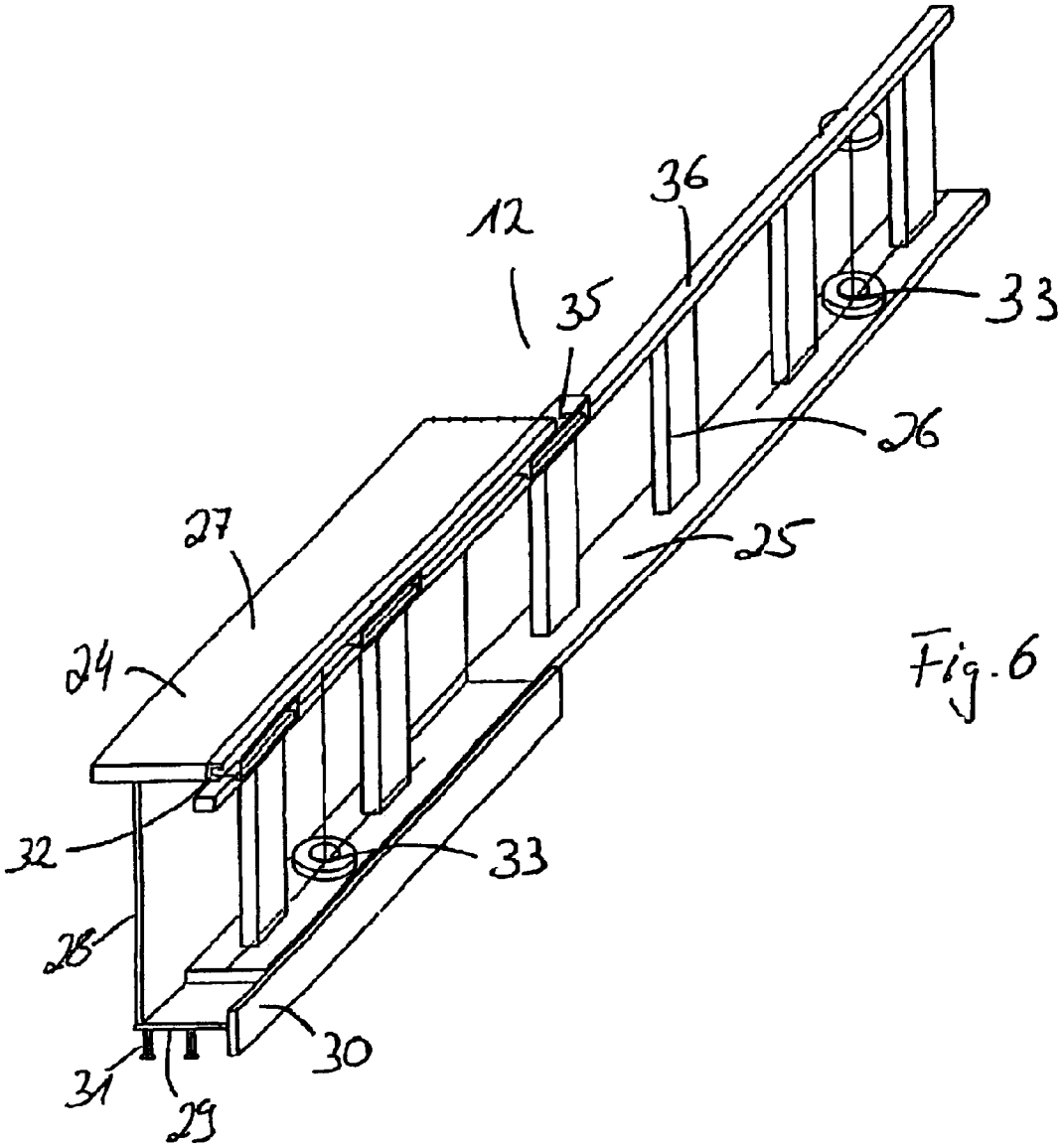

FIG. 6 is a perspective view of the safety means of said bridging device under FIG. 1 for compensation of a transversal load.

Figure 7:
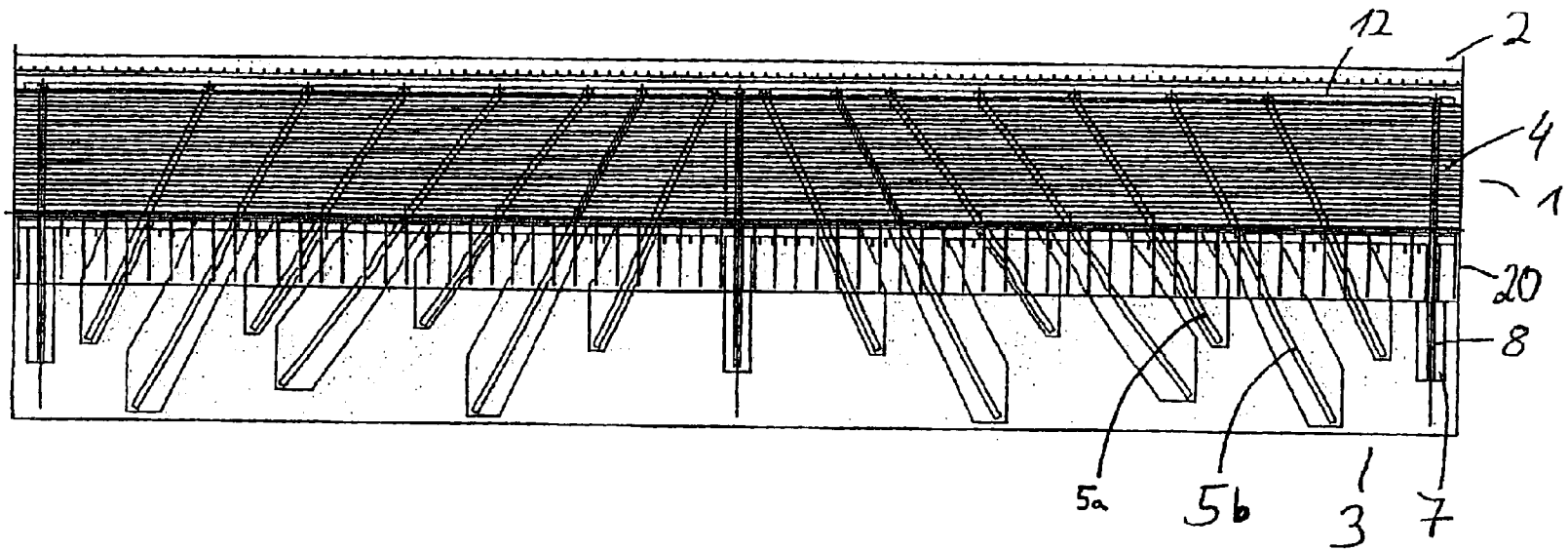

FIG. 7 is a top view onto said bridging device under FIG. 1 with actuated safety means in case of exceeding of the admissible minimum joint gap width (emergency).

Figure 8:
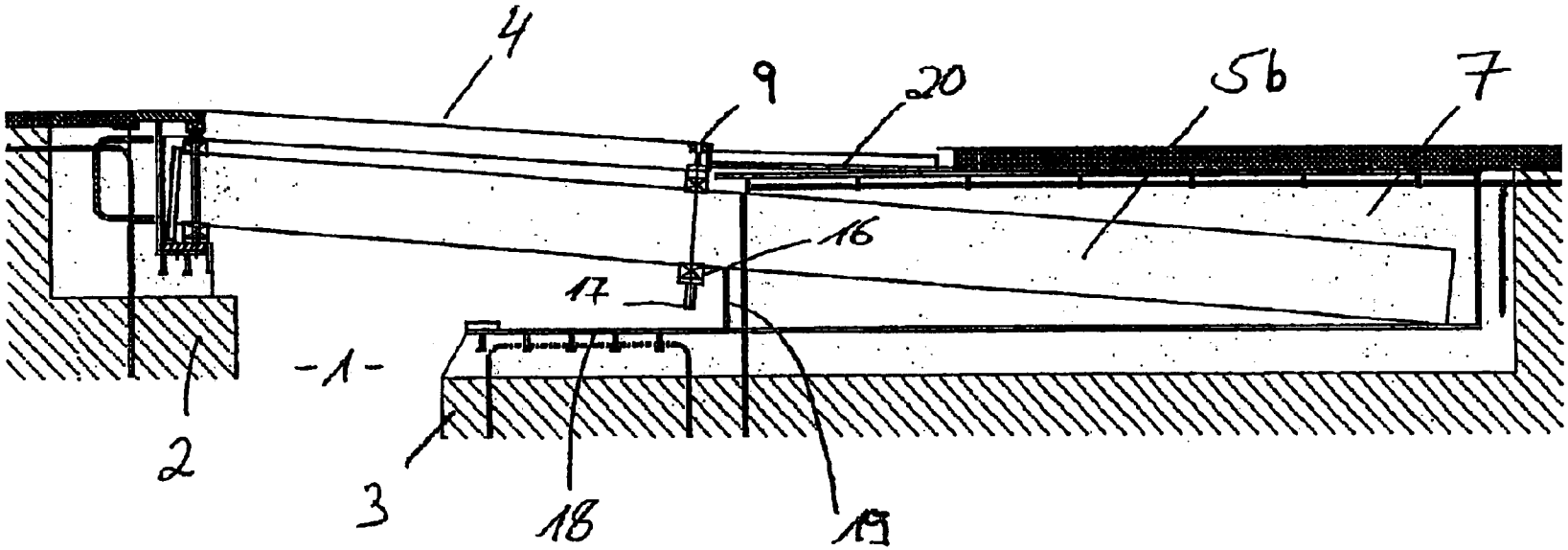

FIG. 8 is a cut view of said bridging device under FIG. 1 in the status of FIG. 7.

Figure 9:
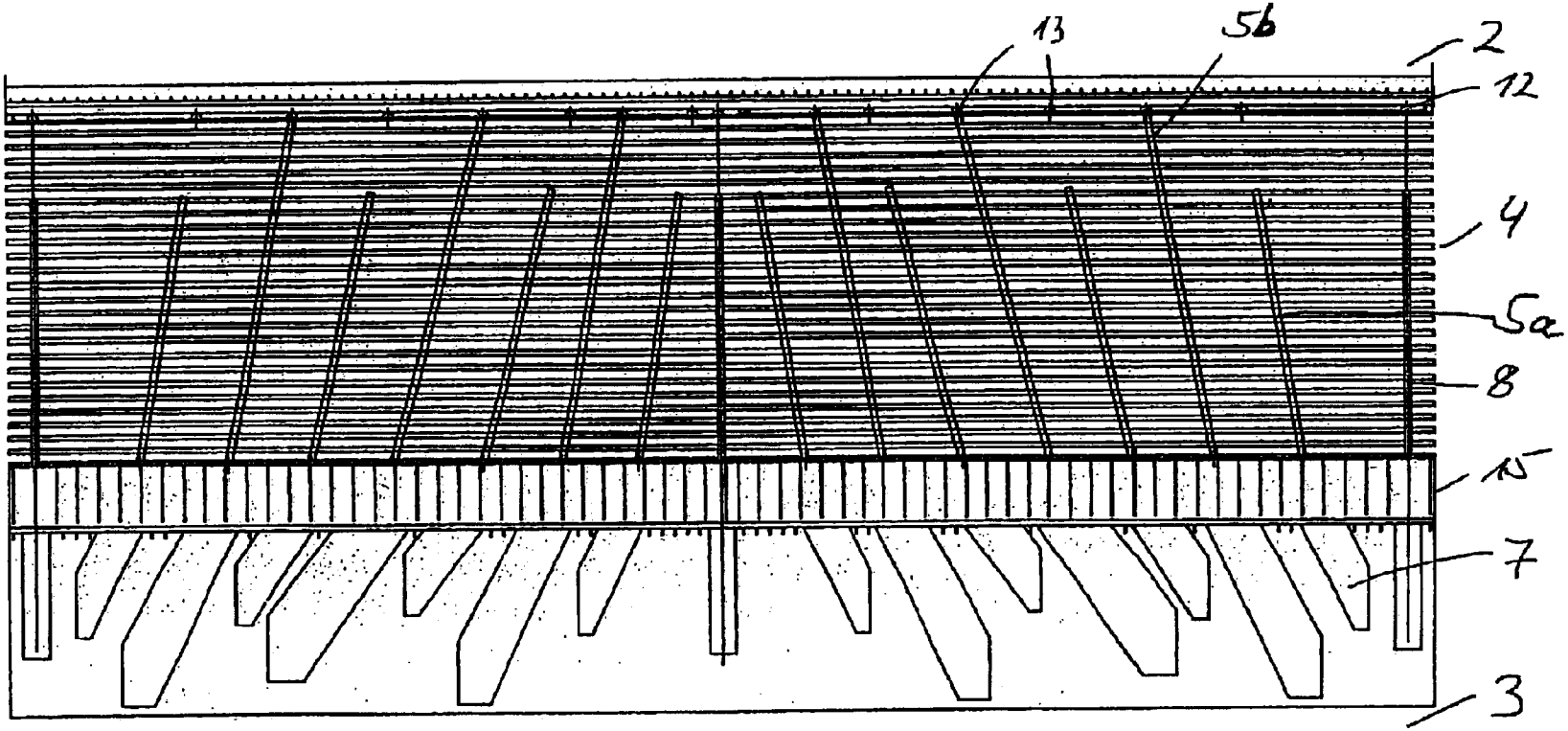

FIG. 9 is a top view onto said bridging device under FIG. 1 in case of exceeding of the maximum joint gap width (emergency).

Figure 10:
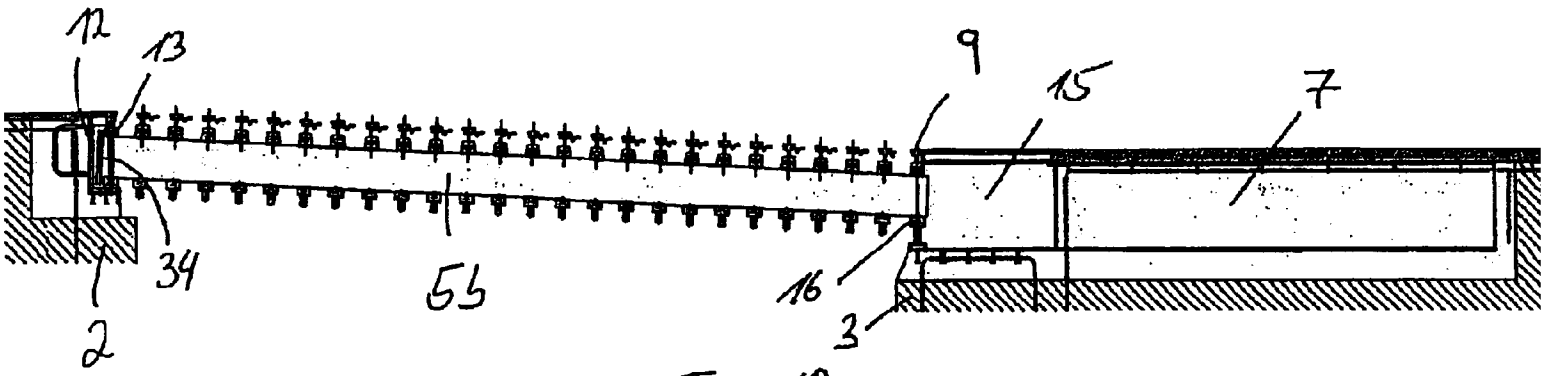

FIG. 10 is a cut view of said bridging device under FIG. 1 in accordance with the status of FIG. 9, along a long crosshead.

Figure 11:
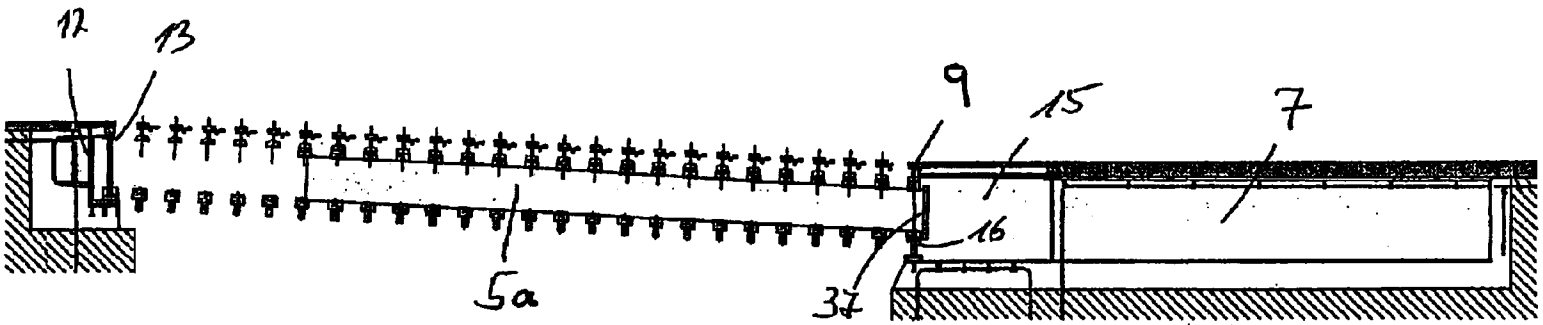
Figure 12:
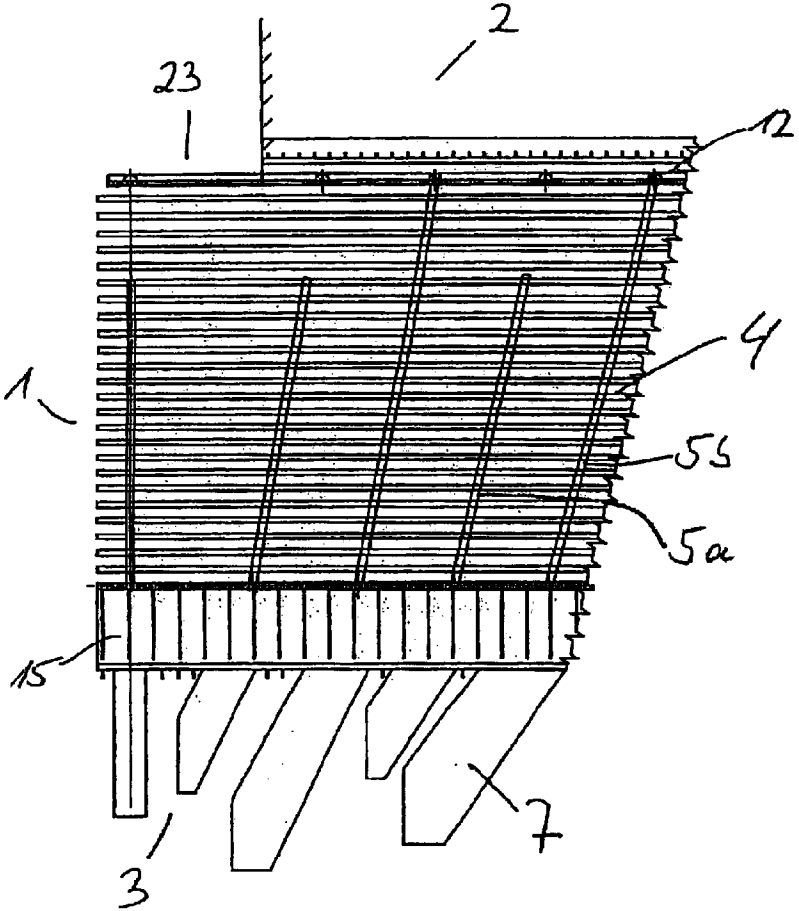

FIG. 11 is a cut view of said bridging device under FIG. 1 in accordance with the status of FIG. 9, along a short crosshead FIG. 12 is a partial top view onto said bridging device under FIG. 1 in a status with exceeded maximum joint gap width and transverse load of said bridging device.

Figure 13:
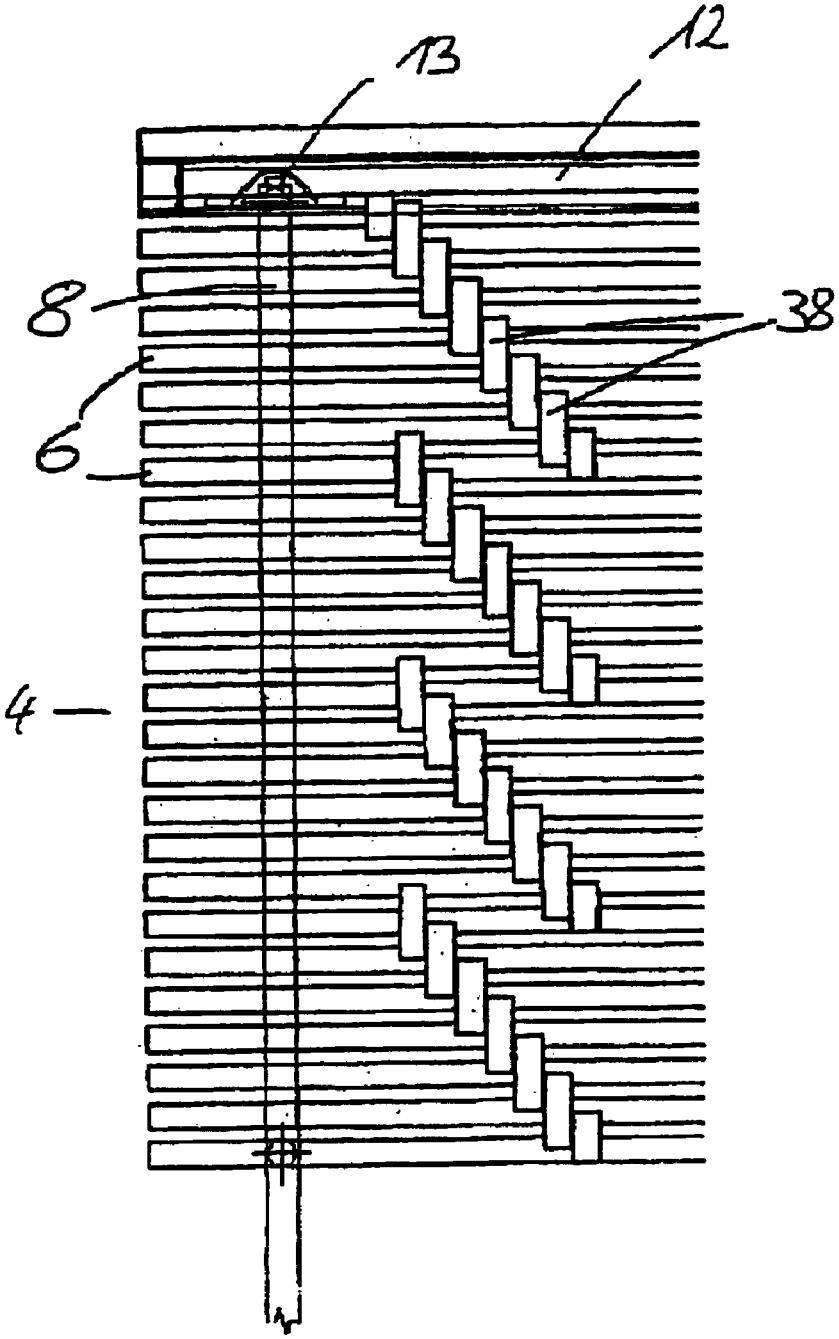

FIG. 13 is partial view from bottom, of said bridging device under FIG. 1 in which stop elements of the release mechanism for the transversal safety means can be seen.

FIG. 14 in partial views (a) and (b) shows a section of the edge area of said expansion joint construction with the edge construction along the long axis of the bridge on the edge of said bridge (partial view (a)) and in the middle of said bridge (partial view (b)).

Figure 15:
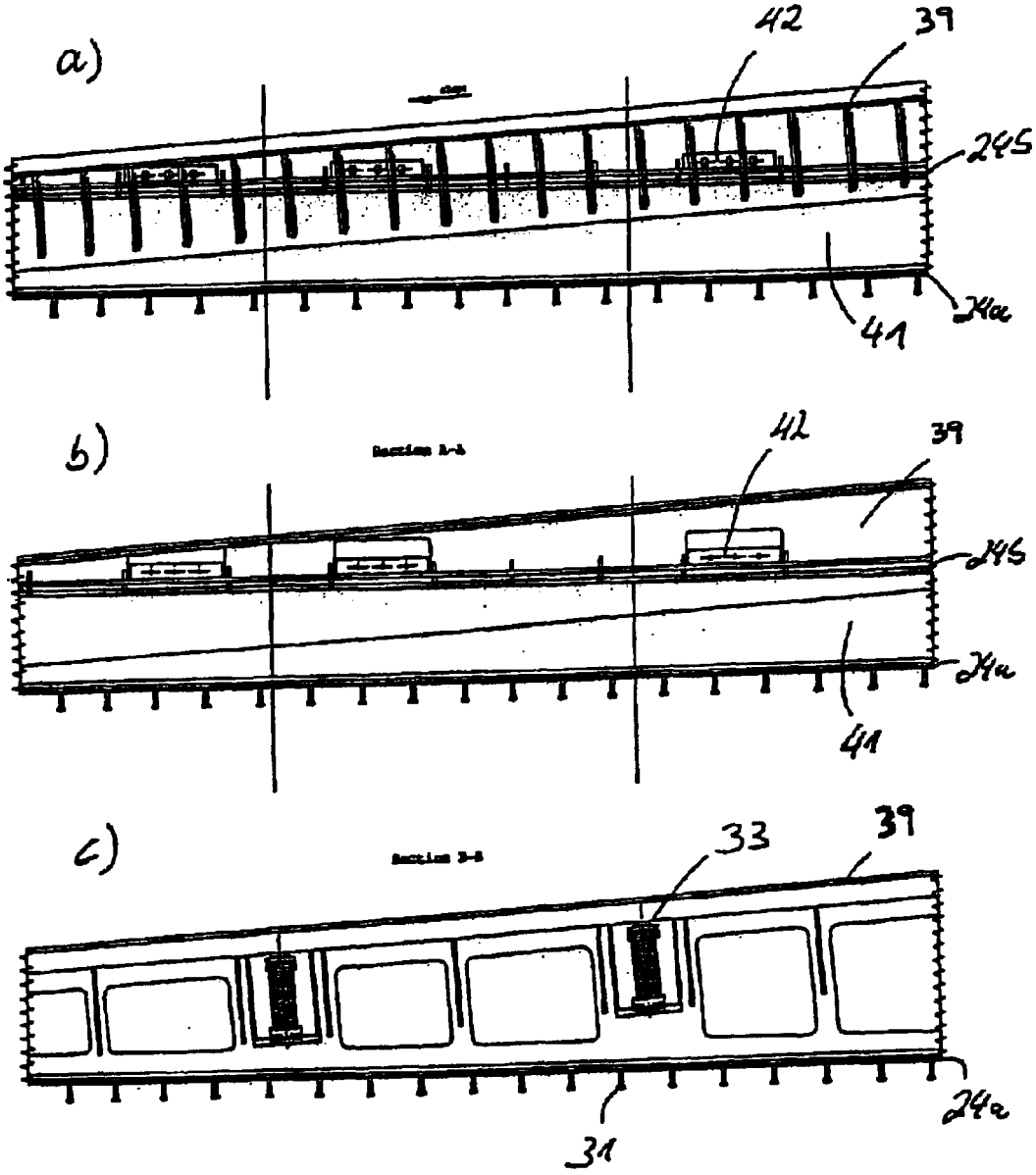

FIG. 15 in partial views (a) to (c) shows a sectional view (a) and two cut views along the cutting lines A—A (b) and B—B (c) of FIG. 14 (a).

DETAILED DESCRIPTION OF THE ILLUSTRATED EMBODIMENT OF THE INVENTION

FIG. 1 shows the bridging device in accordance with the present invention, bridging a joint gap 1 between building parts 2 and 3. Herein, building part 2 e.g. is the stationary bridge head and building part 3 represents the movable bridge construction element. The bridging device in accordance with the present invention, shown in FIG. 1, comprises an expansion joint construction 4 essentially consisting of the roadway crossheads 5*a*, 5*b* and the edge crossheads 8 as well as the central profiles 6 arranged thereon.

Said crossheads 5*a*, 5*b* and 8 with their ends bear on building parts 2 and 3. On the bridge-head side ends said crossheads 5*a*, 5*b* and 8 are firmly received in crosshead connections 13, crossheads 5*a* and 5*b* being pivotably arranged around crosshead connections 13. The other end of crossheads 5*a*, 5*b* an 8 is freely movably received in crosshead boxes 7 which are arranged in the bridge construction element 3 below the bridge deck, e.g. the roadway.

On the building-side edge of said expansion joint construction 4 edge profiles 9 and 11 are provided for which are firmly connected to building parts 2 and 3. Since said central profiles 6 are arranged on said crossheads 5*a*, 5*b* and 8, displaceable by holding stirrups 14 (see FIG. 3), wherein a special arrangement and construction of the slide bearings between said holding stirrups 14 and said crossheads 5*a*, 5*b* and 8 takes care that in case of torsion of said crossheads 5*a*, 5*b* and 8 said central profiles 6 stay arranged at uniform mutual distances, during opening or closing of said joint gap, which may be caused by thermal length changes e.g., a control mechanism takes care that the distances of said central profiles stays uniformly (see also EP-B-512 123). As becomes evident from a comparison of FIGS. 1 and 2, thus in the bridging device shown here during a longitudinal movement of said building parts 2 and 3 with respect to one another, i.e. across said joint gap, not only the mutual distances of said central profiles 6 change but also said crossheads 5*a* and 5*b* change their position with respect to the alignment and the coverage with which they bear on said building part 3 or protrude, respectively, into said crosshead boxes 7.

The manner of functioning of the expansion joint construction 4 also becomes evident from the cut views of FIGS. 3 and 4, corresponding to the status of the expansion joint construction in FIGS. 1 and 2. In the cut view of FIG. 3 it becomes clear in particular in which way the central profile 6 are held by use of the holding stirrups 14 encompassing the crossheads 5*a* and 5*b*. Between the central profiles 6 sealing profiles 10 are provided for which can elastically adapt themselves to the changeable distances between the central profiles 6 and care for sealing of the joint gap 1. From the representations of FIGS. 3 and 4 it moreover also becomes clear that the edge profiles 9 and 11 in each status of the expansion joint construction 4, i.e. with large gap width as well as with narrow gap width, are stationary connected to the building parts 2 and 3.

In spite of the fact that the expansion joint construction shown in FIGS. 1 to 4 already permits a large-scale change of he joint gap width as well as of the across displacement, in the shown embodiment additional safety means are provided for, rendering possible an even stronger movement of the building parts 2 and 3 with respect to one another. Thus, on the edge of the bridge head 2 a transversal safety device 12 is provided for, whereas on the bridge construction element 3 in addition an upset management box 15 is arranged. In addition, due to formation of the differently long crossheads 5*a* and 5*b* and the arrangement thereof on crosshead connections 13 a further protection against strong movements of the building parts 2 and 3 with respect to one another is provided for. At first, however, protection by means of the upset management box 15 is explain d in more detail.

As can be seen in FIG. 1, said upset management box 15 is provided for over the entire width of said bridge construction. It can be seen from FIG. 3 that said upset management box 15 on said bridge construction member 3 is formed by a box bottom 18, a box wall 19, a box cover 20 as well as the edge profile 9 with the edge profile girder 16 which is connected to said box bottom 18 by the bracing 17. Above said box cover 20 an upset management box cover 22 is provided for permitting smooth transition from the roadway surface to said expansion joint construction 4. The individual components of said upset management box 15 can be realized in any suitable manner, e.g. as profiled steel, steel sheet and the like. In order to permit accession for said crossheads into said crosshead boxes 7 crosshead passages 21 are provided for on said box wall 19 in particular.

The mode of functioning of the upset management box 15 becomes clear from FIGS. 7 and 8, showing the status of a maximum reduction of the joint gap 1 between the building parts 2 and 3 without damage of the expansion joint or edge constructions with the exception of he safety means. In the top view of FIG. 7 it herein becomes evident that the roadway crossheads 5*a* and 5*b* in this status are completely received in the crosshead boxes 7 and that the crosshead cover 20 of the upset management box 15 has moved along the roadway surface over the crosshead boxes 7.

In the cut view of FIG. 8 the clear reduction of said joint gap width 1 is evident. Said upset management box 15 in course of the reduction of joint gap width has been separated into essentially two parts which in cross-section have an essentially L-shaped form. The one element is formed by said box bottom 18 and said box wall 19 which are stationary connected to said bridge construction element 3. The other element which in cross-section also has an L-shaped form is formed by said edge profile 9 with said edge profile girder 16 and said box cover 20. By the reduction of said joint gap width the connecting points of said two L-shaped elements, namely the connection of said bracing 17 with said box bottom 18 as well as the seam point between box cover 20 and box wall 19 were opened up. After breaking of said connections the upper L-shaped element together with said box cover 20 could be displaced further in direction of said bridge construction element 3, said box cover 20 having moved almost in parallel to the bridge upper side, i.e. the roadway surface, and therein having removed said upset management box cover 22 from its position as well as also part of said roadway surface. By said upset management box 16, however, further damages of said bridge parts 2 and 3 and/or said expansion joint construction 4, respectively, could be avoided.

As already shown in FIGS. 1 to 4, said bridging device as compared to the shown embodiment further on comprises a safety means for continuous compensation of excessive transversal movements between said building parts 2 and 3, which as transversal safety device has been denominated with reference numeral 12. FIG. 6 in a perspective view shows a partial view of said transversal safety device 12 essentially consisting of a rail 24 and a slide 25 movable along said rail after a maximum threshold load having been exceeded.

Said rail 24 consists of an upper part 27, a rear wall 28 and a rail bottom 29 as well as of a guide plate 30 so that said slide 25 is displaceably guided in the space between rear wall 28, bottom 29 and guide plate 30. At said bottom 29 of said rail 24 in addition anchorings 31 are provided for, permitting embedding of said rail into the edge construction of said bridge head 2. Said rail 24 consists of two bars 36 arranged in parallel, which are mutually connected by braces 26. In addition said slide 25 comprises crosshead receptions 33 for formation or said crosshead connections 13 into which said roadway crossheads 5*a*, 5*b* or said edge crossheads 8, respectively, can be received. At the upper part 27 furthermore also a sealing profile reception 32 is provided for.

Said slide 25 is chucked between said upper part 27 and said bottom 29 of said rail 24 by means of elastically tensionable slide bearings 35 so that a frictional force corresponding to the desired threshold load is created between said lower bar 36 of said slide 25 and said bottom 29 of said rail 24. Alternatively or in addition, also stop members which in case of standard load of said bridging device limit the movement of said slide 25 can be provided for in said rail. In case of exceeding of said threshold load then said stop members are removed by said slide 25, e.g. are separated from said rail 24 at a predetermined breaking point.

In order to initiate a movement if said slide 25 in said rail 24, different starting mechanisms are conceivable. On one hand said roadway crossheads 5*a* and 5*b* of said expansion joint construction can be located such that in case of a transversal load of bridging device they cause jamming of said expansion joint construction 4 so that a transmission of the transversal forces onto said transversal safety device 12 becomes possible. Alternatively it also is conceivable that in suitable manner stops which in case of exceeding of a given movement range also would permit transmission of transversal forces onto said transversal safety device 12 are arranged between said roadway crossheads 5*a* and 5*b* and between said central profiles 6, respectively.

When said transversal safety device 12 is actuated, said slide 25 moves in said rail 24 in accordance with the acting transversal force and thus permits a transversal displacement between said building parts 2 and 3. This is shown in FIG. 5 e.g. In FIG. 5 the transversal displacement between said bridge head 2 and said bridge construction element 3 is marked with reference numeral 23. Herein it has to be noted still that said rail 24 need not extend over the entire bridge breadth but that individual small sections can be sufficient.

Beside the possibilities of load of said expansion joint construction shown in FIGS. 5 to 8, namely a transversal load as well as a longitudinal load in such way that the joint gap width is reduced, said bridging device of the shown embodiment also permit protection against excessive longitudinal movements of said building parts 2 and 3 with respect to one another, in which said joint gap width increases or exceeds, respectively, a given threshold value. This is shown in FIGS. 9 to 11.

Whereas FIG. 9 shows a top view onto said bridging device in accordance with the embodiment of FIG. 1 in a status in which the admissible joint gap width is exceeded, the cut views of FIGS. 10 and 11 show this status in cross-sectional views along long crossheads 5*b* (FIG. 10) and short crossheads 5*a* (FIG. 11). As can be seen from FIG. 9, in case of exceeding of the maximally admissible joint gap width said short roadway crossheads 5*a* and said edge crossheads 8 left said crosshead connections 13, whereas said long crossheads 5*b* still are received in said crosshead connections 13. In spite of the fact that the number of supporting crossheads is very small and coverage of crosshead support in said crosshead boxes 7 is minimum, due to the stabilization of said expansion joint construction 4 with said short crossheads 5*a* by means of said central profiles 6 sufficient stability of said expansion joint construction 4 is guaranteed.

As can be seen in FIG. 10, in case of exceeding of maximum joint gap width the long crossheads 5*b* are completely extended from the crosshead boxes 7, namely so far that they just still are received in the edge profile 9 or in the edge profile girders 16, respectively. On the other side the long crossheads 5*b* are safely received in crosshead terminals 13 via a crosshead safety member 34.

The short crossheads 5*a*, however, (see FIG. 11) slid out of the crosshead connections 13 and moved away from those, wherein before that the crosshead safety member 34 was removed at the predetermined threshold load. As crosshead safety member 34 all suitable measurements, e.g. securing pins, stop members and the like, can be used. On the other side on he end of the short crossheads 5*a* on the end thereof on the side of the bridge construction element it is made sure that the short crossheads 5*a* cannot slide out of the edge profile or the edge profile girder 16, respectively. For this purpose crosshead plates 37 which have a larger diameter than the short crossheads 5*a* and thus cannot pass the edge profile girder 16, can be arranged on the short crossheads 5*a* e.g. This construction provides the advantage that in spite of a too low number of sufficiently long crossheads, for reasons of costs or space e.g., maintenance of use in emergency situations is guaranteed.

FIG. 12 shows a status of the shown embodiment of the bridging device in accordance with the present invention in which in addition to the exceeded maximum longitudinal extension of said expansion joint construction 4 additionally a transverse displacement 23 of said building parts 2 and 3 occurs.

FIG. 13 shows a partial view from bottom, of bridging device in which the stop members 38 of the release mechanism for the transversal safety member can be seen. As can be seen in FIG. 13, depending on the arrangement of the stop members 38 the latter come into contact with one another in case of movement of the central profiles 6 or the edge profiles 9, respectively, in longitudinal direction of the gap so that with a given configuration a transverse force is transmitted to the edge construction or the safety member 12, respectively, the latter being released in case of a threshold load being exceeded.

A further embodiment of the bridging device in accordance with the present invention is shown in FIGS. 14 and 15. The embodiment shown in these figures differs from the embodiment described before in that the transversal safety member 12 is modified.

As can be seen in FIG. 14 in partial views (a) and (b) which show cut views across the longitudinal direction of said gap on the edge or the bridge and in the middle of said bridge, said transverse safety means 12' comprises a slide 25 including slide parts 25*a* and 25*b* as well as the movable edge construction 39 and the wedge plate 41. Said wedge plate 41 is arranged on said slide part 25*a* which is movable in said rail part 24*a* in a horizontal plane.

As can be seen from FIG. 15 in partial views (a) and (b), the—height of said wedge plate 41 increases from the bridge edge to the bridge center so that a wedge shape results. When said expansion joint construction comprises two wedge plates 41, the resulting bridge will in cross-section have a roof shape, wherein of said roadway sides each is somewhat inclined to one side so that water can rinse off. However, it also is conceivable that said expansion joint construction includes only one wedge plate 41 so that the surface of said bridge is somewhat inclined from one edge to the other edge of said bridge, wherein here, too, the water can rinse off correspondingly. Said bridging device in accordance with the present invention, shown in FIGS. 14 and 15 is suitable for the one as well as for the other embodiment of bridges.

As can also be seen in FIG. 15 in partial views (a) and (b), said wedge plate 41 balances the oblique arrangement of the movable edge construction 39 with respect to horizon. Thus, said slide part 25*a* can also be horizontally moved in said rail part 24*a* also in case of oblique arrangement of said edge profile 11.

Since in case of actuation of transversal safety member by the inclined roadway surfaces a displacement in height occurs between the mutually movable parts, in this embodiment of the bridging device in accordance with the present invention a first movable edge construction 39 is provided for in which the crossheads 5*a* and 5*b* well as edge profile 11 with the edge profile girder 16 are received. To make sure that the movable edge construction 39 is stabilized in a direction across the gap, a second rail part 24*b* is provided for, which is arranged on a second stationary edge construction 40. With the second rail part 24*b* which in the shown embodiment is realized in hook shape, an also hook-shaped slide part 25*b* engages so that in across direction of the gap toothing results. In longitudinal direction of the gap the rail part 24*b* and the slide part 25*b*, however, again represent a horizontally movable rail-slide pair.

To make sure that movable edge construction 39 cannot be lifted off in vertical direction or that the mutual interlocking of rail part 24*b* and slide part 25*b* releases, a lifting lock 42 is provided for which in simple way consists of a stop member disposed above slide part 25*b* in such way that the latter can no longer be removed from rail part 24*b*.

Since also rail-slide pair of slide part 25*b* and rail part 25*b* move in a horizontal plane, slide part 25*b* is located with different distance to the upper edge of movable edge construction 39. If now transversal safety member 12' is actuated in emergency case, slide 25 with slide part 25*a* and 25*b*, wedge plate 41 and movable edge construction 39 moves with respect to stationary edge construction 40 and rail parts 24*a* and 24*b*. Due to the movement a displacement in height between stationary edge construction 40 and movable edge construction 39 is caused, so that said sealing profile arranged between stationary edge construction 40 and movable edge construction 39 is correspondingly distorted and in worst case is torn out of the anchoring. Thus, however, in worst case sealing profile 10 between stationary edge construction 40 and movable edge construction 39 is destroyed, whereas the remaining edge construction is protected. The embodiments of the kind shown in FIGS. 14 and 15 also comprises advantages with respect to assembly, as said movable edge construction 39 can be assembled said with expansion joint construction already in the plant. The entire expansion joint construction then after arrangement of said rail parts 24*a* and 24*b* only needs to be lifted in the latter, wherein subsequently said lifting protection 42 is mounted and said sealing profile 10 is installed.

To make sure that said movable edge construction 39 cannot be lifted off in vertical direction or that the mutual lock of said rail part 24*b* and said slide part 25*b* gets loose, a lifting lock 42 is provided for which in simple manner consists of a stop member which in simple manner is disposed above said slide part 25*b* so that the latter can no longer be removed from said rail part 24*b*.

LIST OF REFERENCE NUMERALS

| | |
|---|---|
| 1 | joint gap |
| 2 | bridge head |
| 3 | bridge construction element |
| 4 | expansion joint construction |
| 5 | roadway crosshead |

-continued

| LIST OF REFERENCE NUMERALS | |
|---|---|
| 5a | short roadway crosshead |
| 5b | long roadway crosshead |
| 6 | central profile |
| 7 | crosshead box |
| 8 | edge crosshead |
| 9 | edge profile (on bridge construction element) |
| 10 | sealing profile |
| 11 | edge profile (on bridge head) |
| 12,12' | transversal safety device |
| 13 | crosshead connection |
| 14 | profile girder |
| 15 | upset management box (Fuse Box) |
| 16 | edge profile girder |
| 17 | bracing/brace |
| 18 | box bottom |
| 19 | box wall |
| 20 | box cover |
| 21 | crosshead passage |
| 22 | cover of upset management box |
| 23 | transversal displacement |
| 24 | rail |
| 24a, b | rail parts |
| 25 | slide |
| 25a, b | slide parts |
| 26 | brace |
| 27 | upper part |
| 2 | rear wall |
| 29 | bottom |
| 30 | guide plate |
| 31 | anchoring |
| 32 | sealing profile reception |
| 33 | crosshead reception |
| 34 | crosshead safety element |
| 35 | slide bearing |
| 36 | bar |
| 37 | crosshead plate |
| 38 | stop members |
| 39 | movable edge construction |
| 40 | stationary edge construction |
| 41 | wedge plate |
| 42 | safety element against lifting/lifting lock |

What is claimed:

1. A bridging device for joint gaps (1) between building parts (2, 3) including bridge parts, with an expansion joint construction (4) bridging a joint gap (1), said expansion joint construction (4) permitting position changes of said building parts (2, 3) with respect to one another in given first limits, characterized by a safety means **(12; 15; 34; 5*a*) permitting a position change of said building parts (2, 3) with respect to one another within second limits exceeding said first limits or remaining therebelow, without a separation destroying said building parts (2/3) and/or said expansion joint construction (4) occurring, wherein said safety means (12; 15; 34; 5*a*) includes at least two firmly mutually connected elements which after exceeding of a defined threshold load are separated and movable with respect to one other in defined manner, and wherein one element is firmly arranged on one of aid building parts (2, 3), whereas the other element is part of said expansion joint construction (4) or accommodates the same and said two elements of said safety means (12) being formed by a rail (24) and a slide (25), said slide (24) after exceeding of said threshold loading being displaceable in said rail (25)** in order to balance shifting movements including transversal movements between bridge parts.

2. The bridging device as defined in claim 1, wherein said slide (25) is tensioned in said rail (24), by elastically tensionable slide bearings (35), which are arranged between rail (24) and slide (25) in such manner that the tensile force produces a frictional force between slide (25) and rail (24), corresponding to said threshold load.

3. The bridging device as defined in claim 1, wherein said slide includes at least one wedge plate (41) so that an edge profile (11) with an edge profile girder is arranged in an edge construction movable with said slide, obliquely with respect to the horizon.

4. The bridging device as defined in claim 1, wherein said rail (24) comprises two parts **(24*a*, 24*b*) separated in space, wherein each rail part (24*a*, 24*b*)** is arranged horizontally.

5. The bridging device as defined in claim 4, wherein said slide (25) in cross-section is made wedge-shaped or double-wedge-shaped and is shiftably supported in both rail parts **(24*a*, 24*b*)**.

6. The bridging device as defined in claim 5, wherein said two rail parts **(24*a*, 24*b*)** are vertically arranged with a continuous uniform distance to one another.

7. The bridging device as defined in claim 4, wherein said slide (25) includes an edge construction (39) movable together with said slide and which extends inclined with respect to said rail (24) or said rail parts **(24*a*, 24*b*)**, respectively.

8. The bridging device as defined in claim 1, wherein a sealing profile (10) is arranged between a movable edge construction (39) arranged on said slide (25) and a stationary edge construct on (40).

9. The bridging device as defined in claim 1, wherein said rail (24) is firmly arranged on a building part (2, 3) and said slide (25) receives said expansion joint construction (4).

10. The bridging device as defined in claim 1, wherein said rail (24) comprises at least one stop member for limiting the movement of said slide (25).

11. The bridging device as defined in claim 1, wherein a release mechanism for actuating said safety means (12) is provided and includes a mechanism for transmitting transversal forces along the longitudinal direction of said gap, and wherein said release mechanism is formed by one or several stop members (38) arranged on at least one of central profiles (6) or edge profiles (9 or 11).

12. A bridging device for joint gaps (1) between building parts (2, 3) including bridge parts, with an expansion joint construction (4) bridging a joint gaps (1), said expansion joint construction (4) permitting position changes of said building parts (2, 3) with respect to one another in given first limits, characterized by a safety means **(12; 15; 34; 5*a*) permitting a position change of said building parts (2, 3) with respect to one another within second limits exceeding said first limits or remaining therebelow, without a separation destroying aid building parts (2/3) and/or said expansion joint construction (4) occurring, wherein said safety means (12; 15; 34; 5*a*) includes at least two firmly mutually connected elements which after exceeding of a defined threshold load are separated and movable with respect to one another in defined manner, and wherein one element is firmly arranged on one of said building parts (2, 3), whereas the other element is part of said expansion joint construction (4) or accommodates the same and said safety means (12) includes a housing separable into at the least two elements (15)**, which encloses a hollow space and said two elements are embodied as profile shapes which after exceeding of the threshold load move towards one another therein consuming said hollow space.

13. A bridging device for joint gaps (1) between building parts (2, 3) including bridge parts, with an expansion joint construction (4) bringing a joint gap (1), said expansion joint construction (4) permitting position changes of said building parts (2, 3) with respect to one another in given first limits, characterized by a safety means (12; 15; 34; 5*a*) permitting a position change of said building parts (2, 3) with respect to one another within second limits exceeding said first limits or remaining therebelow, without a separation destroying said building parts (2/3) and/or said expansion joint construction (4) occurring, wherein said safety means (12; 15; 34; 5*a*) includes at least two firmly mutually connected elements which after exceeding of a defined threshold load are separated and movable with respect to one another in defined manner, and wherein one element is firmly arranged on one of said building parts (2, 3), whereas the other element is part of said expansion joint construction (4) or accommodates the same and said safety means (15) has an ashlar-type basic structure, wherein said two connected elements of said safety means (15) are formed by two essentially L-shaped profile shapes, and wherein said two L-shaped profile shapes after exceeding of the predetermined threshold load can move with respect to one another and namely such that opposing sides of said ashlar-shaped basic structure move towards one another.

14. The bridging device as defined in claim 12, wherein said one profile shape is firmly arranged on one building part (2, 3), whereas said other profile shape receives said expansion joint construction (4) and one leg of an L-shaped profile shape encloses a edge profile (9) of said expansion joint construction (4).

15. The bridging device as defined claim 12, wherein said expansion joint construction (4) includes crossheads (5*a*, 5*b*, 8) bridging said joint gap (1), wherein said crossheads (5*a*, 5*b*, 8) are movably received in both profile shapes in a profile girder (16) of an edge profile (9) of one of said profile shapes as well as an opposing leg (19) of another L-shaped profile shape, for thereby forming guide for the movement of said profile shapes.

16. The bridging device as defined in claim 13, wherein one leg (2) of said L-shaped profile shape movable with respect to said building part is arranged in parallel to a surface of one of said build parts, and, during movement of said L-shaped profiled shapes with respect to one another along said building part, is displaced in order to therein cause one of engagement under the surface of said building or detachment of a upset management box cover (22) on said building part.

17. The bridging device as defined in claim 12, wherein said profile shapes are formed of full-surface steel profiles, of grid type structure or of individual components including steel sheets, edge profile elements and profile girders.

18. A bridging device for joint (1) between building parts (2, 3) including bridge parts, with an expansion joint construction (4) bridging a joint gap (1), said expansion joint construction (4) permitting position changes of said building part (2, 3) with respect to one another in given first limits, characterized by a safety means (12; 15; 34; 5*a*) permitting a position change of said building parts (2, 3) with respect to one another within second limits exceeding said first limits or remaining therebelow, without a separation destroying aid building parts (2/3) and/or said expansion joint construction (4) occurring, wherein said safety means (12; 15; 34; 5*a*) includes at least two firmly mutually connected elements which after exceeding of a defined threshold load are separated and movable with respect to one another in defined manner, and wherein one element is firmly arranged on one of said building parts (2, 3), whereas the other element is part of said expansion joint construction (4) or accommodates the same and said expansion joint construction includes crossheads (5*a*, 5*b*, 8) bridging said joint gap, wherein said safety means as part of said expansion joint construction (4) are embodied such that said crossheads (5*a*, 5*a*) have different lengths, least one first length (short crossheads (5*a*)) and a second length (long crossheads (5*b*)), wherein said crossheads of said first length comprise an anchoring (34) on one building part which is a stationary bridge head, as an element of said safety means, which in case of exceeding of said threshold load is detached from said crosshead bodies of said crossheads (5*a*) of a first length as another element of said safety means so that said crossheads (5*a*) of said first length can move away from said anchoring (34) in a defined manner.

19. The bridging device as defined in claim 18, wherein said crossheads (5*a*) of said first length on their end opposing said anchoring comprise a crosshead plate (37), which effects the movement of said crosshead (5*a*) of said first length way from said anchoring (34), by a stop of said crosshead plate (37) to an edge profile (9).

20. The bridging device as defined in claim 18, wherein said crossheads (5*b*) of said second length, together with cover profiles (6) arranged on said crossheads (5*a*, 5*b*, 8), serve as guide elements for said crossheads (5*a*) of said first length.

* * * * *